US005166651A

United States Patent [19]

Jacobs et al.

[11] Patent Number: 5,166,651

[45] Date of Patent: Nov. 24, 1992

[54] MOLDED CASE CIRCUIT BREAKER ARC EXHAUST GAS CONTROLLER

[75] Inventors: Linda Y. Jacobs, Barkhamsted; Joseph M. Palmieri, Southington; James I. Smith, Avon, all of Conn.; Franco Pardini, Milan, Italy

[73] Assignee: General Electric Company, New York, N.Y.

[21] Appl. No.: 736,673

[22] Filed: Jul. 26, 1991

[51] Int. Cl.[5] ..... H01H 9/02

[52] U.S. Cl. ..... 335/202; 335/201; 200/144 R

[58] Field of Search ..... 335/201-202, 335/6, 35, 167-176, 202; 200/144 R, 147 R

[56] References Cited

U.S. PATENT DOCUMENTS 4,146,855 3/1979 Schultz et al. ..... 335/8
4,589,052 5/1986 Dougherty .
4,639,564 1/1987 Grunert et al. .
4,728,914 3/1988 Morris et al. .
4,754,247 6/1988 Raymont et al. .
4,928,080 5/1990 Jacobs et al. .
4,963,849 10/1990 Kowalcyzk et al. .

*Primary Examiner*—Lincoln Donovan
*Attorney, Agent, or Firm*—Richard A. Menelly; Fred Jacob

[57] ABSTRACT

An arc gas controller-insert is used with molded case circuit breaker covers to direct the flow of arc gases that occur during intense overcurrent circuit interruption. The gas controller-insert provides access to the line and load terminal lugs for connection with and disconnection from an associated electrical power distribution system while controlling the egress of the arc gases.

10 Claims, 3 Drawing Sheets

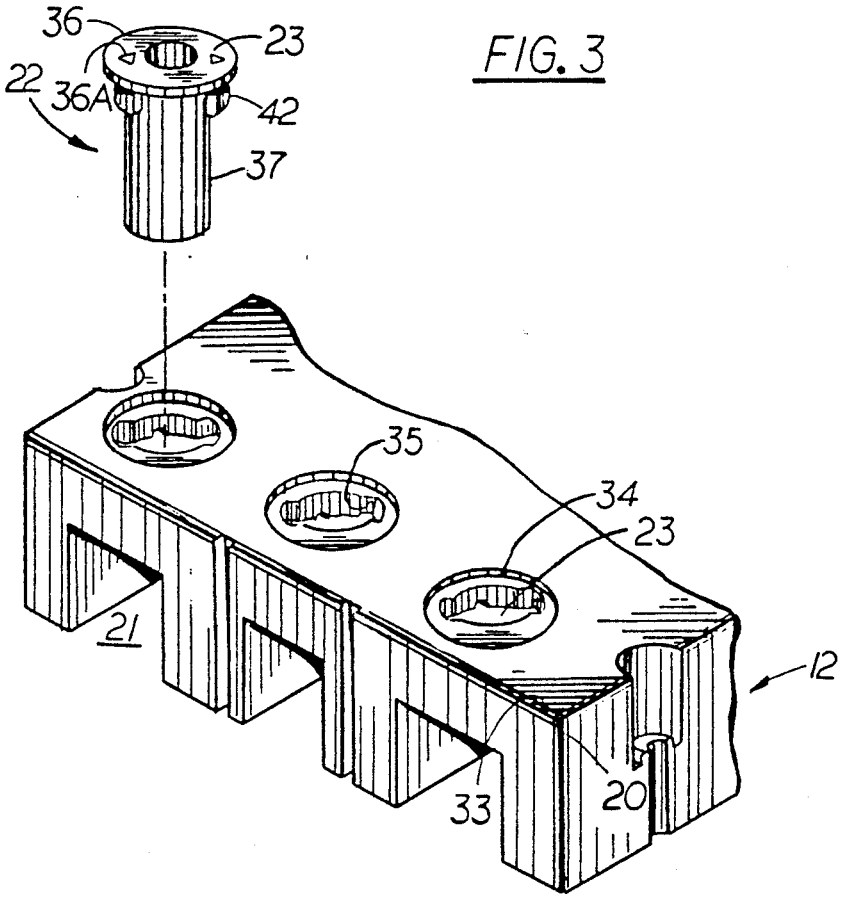
FIG. 3
FIG. 4
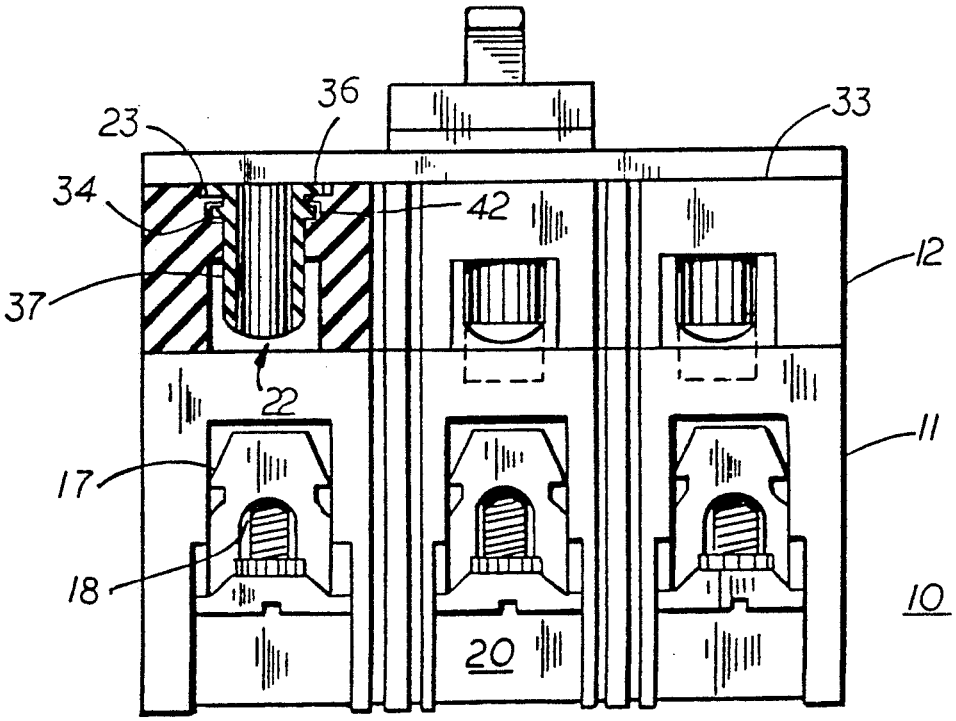

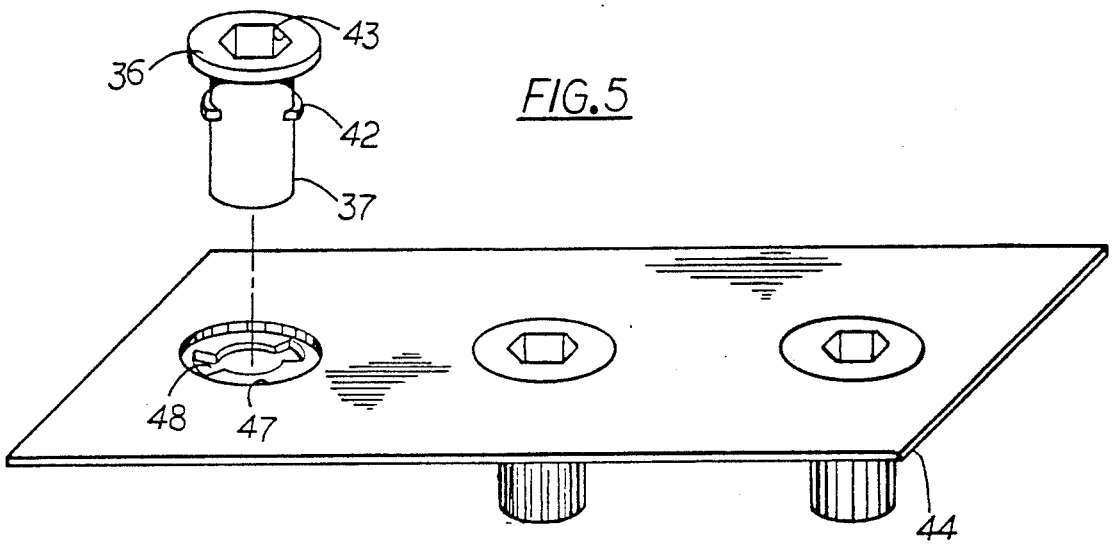
FIG.5
FIG.6
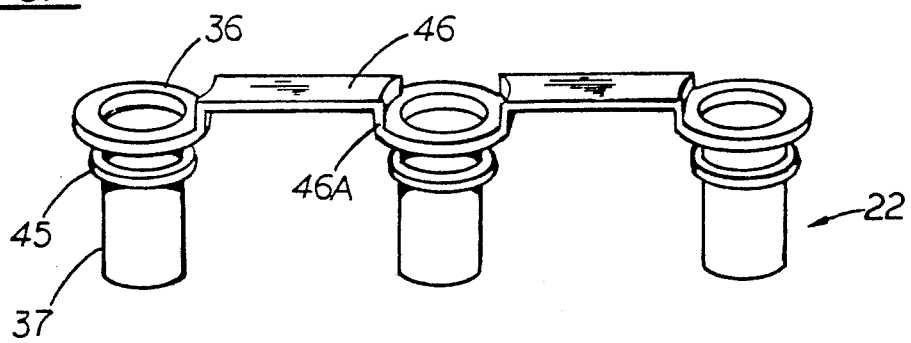

MOLDED CASE CIRCUIT BREAKER ARC EXHAUST GAS CONTROLLER

BACKGROUND OF THE INVENTION

The use of removable plugs to prevent access to the line terminals of industrial-rated circuit breakers is described in U.S. Pat. No. 4,754,247 wherein the removable plugs are inserted in the circuit breaker cover within the access holes to the line terminals. The plugs are removed when connecting the circuit breakers within an electrical distribution circuit and are later replaced to prevent accidental contact with the energized line terminals.

When a compact current limiting circuit breaker, such as that described within U.S. Pat. No. 4,963,849 entitled "Compact Current Limiting Circuit Breaker" is used within an industrial power distribution circuit, intense arc gases are generated during overcurrent interruption. During the existence of the arc, high temperature gases are generated which must exit from the line side of the circuit breaker enclosure in order to prevent the circuit breaker enclosure from becoming over-stressed. During the arc occurrence, some means must usually be employed to prevent the ionized gases from contacting the associated grounded enclosure to thereby prevent the occurrence of a so-called "line-to-ground" fault. Further means must be employed to prevent the arc gases exiting from one line terminal compartment from contacting a line terminal connector within an adjacent line terminal compartment to prevent a so-called "phase-to-phase" fault.

U.S. Pat. No. 4,639,564 describes one such means integrally-formed within the circuit breaker cover to prevent the arc gases from causing electrical breakdown between a terminal and a proximate conductor.

U.S. Pat. No. 4,928,080 describes a line terminal plug that controls the flow of the arc exhaust gases and prevents access to the line terminal lugs. To connect and disconnect the line terminal lugs within the electric power distribution system, the line terminal plugs must first be removed and then later reinserted within the circuit breaker cover.

This invention accordingly provides means for providing access to the line terminals for connecting and disconnecting the line terminals while simultaneously controlling the egress of arc gases from the circuit breaker enclosure.

SUMMARY OF THE INVENTION

Line terminal gas controller inserts that control arc gas flow are both factory and field-installable within the line lug access openings in a circuit breaker cover. The inserts cooperate with keyways integrally-formed within the circuit breaker cover to fixedly hold the inserts within the line terminal access openings. The inserts provide access to the line terminals for installation and removal while at the same time controlling the egress of arc gases from the circuit breaker enclosure. The thermoplastic plastic material used to form the line terminal inserts is more efficient for cooling the arc gases than the thermoset plastic material used to form the circuit breaker case and cover.

BRIEF DESCRIPTION OF THE DRAWINGS

FIG. 3 is an enlarged top perspective view of the end of the circuit breaker cover depicted in FIG. 1 prior to installation of the line terminal inserts;

FIG. 4 is an end view in partial section of the circuit breaker shown in FIG. 1;

FIG. 5 is a top perspective view of a further embodiment of the line terminal inserts according to the invention; and FIG. 6 is a top perspective view of an additional embodiment of the line terminal units according to the invention.

DESCRIPTION OF THE PREFERRED EMBODIMENT

Figure 1:
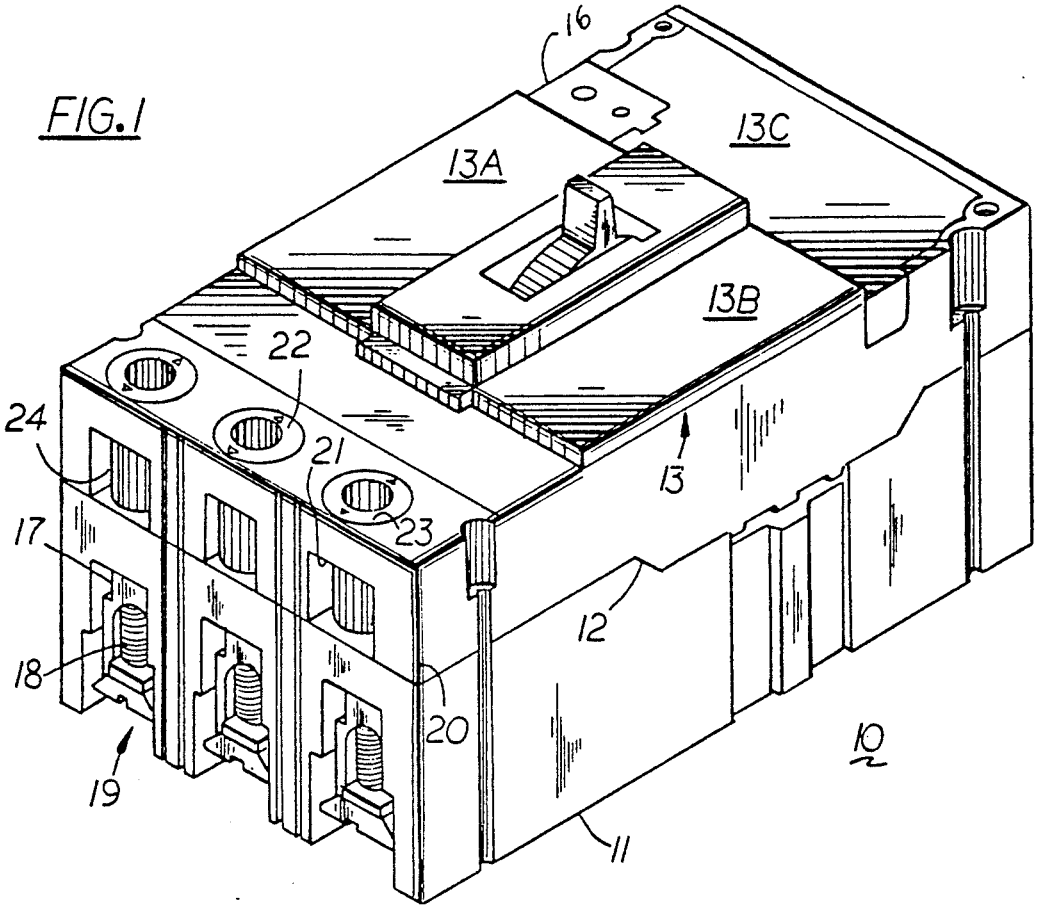
FIG. 1 is a top perspective view of a circuit breaker employing one embodiment of the line terminal inserts in accordance with the invention.

A compact circuit breaker 10 of the type controlled by an electronic trip unit is shown in FIG. 1 to consist of a molded plastic case 11 to which a molded plastic cover 12 is attached. An accessory cover 13 allows access to an accessory such as an auxiliary switch, or bell alarm (not shown) under accessory door 13A while a separate accessory door 13B allows access to an electromagnetic trip actuator, also not shown. An electronic trip unit, such as that described in U.S. Pat. No. 4,589,052, is located under the accessory door 13C. An externally accessible rating plug 16, such as described within U.S. Pat. No. 4,728,914, is inserted within the accessory cover and electrically connects with the electronic trip unit. Electrical connection with the electrical power distribution circuit is made by means of the line terminal connectors consisting of the line lugs 17 and line terminal screws 18 which are located within the line terminal compartments 19. When the line terminal lugs are to be field-installed, cylindrical line terminal inserts 22 are positioned within the line terminal access slots 23. The arc gases that are generated within the circuit breaker case during intense overcurrent circuit interruption readily exit through the spaces 24 defined between the exterior surface of the inserts and the openings 21 formed within the line terminal end 20 of the cover. To prevent external access to the line terminal connectors, a line terminal plug such as described within U.S. Pat. No. 4,928,080 can be additionally inserted through the top of each of the inserts, if so desired.

Figure 2:
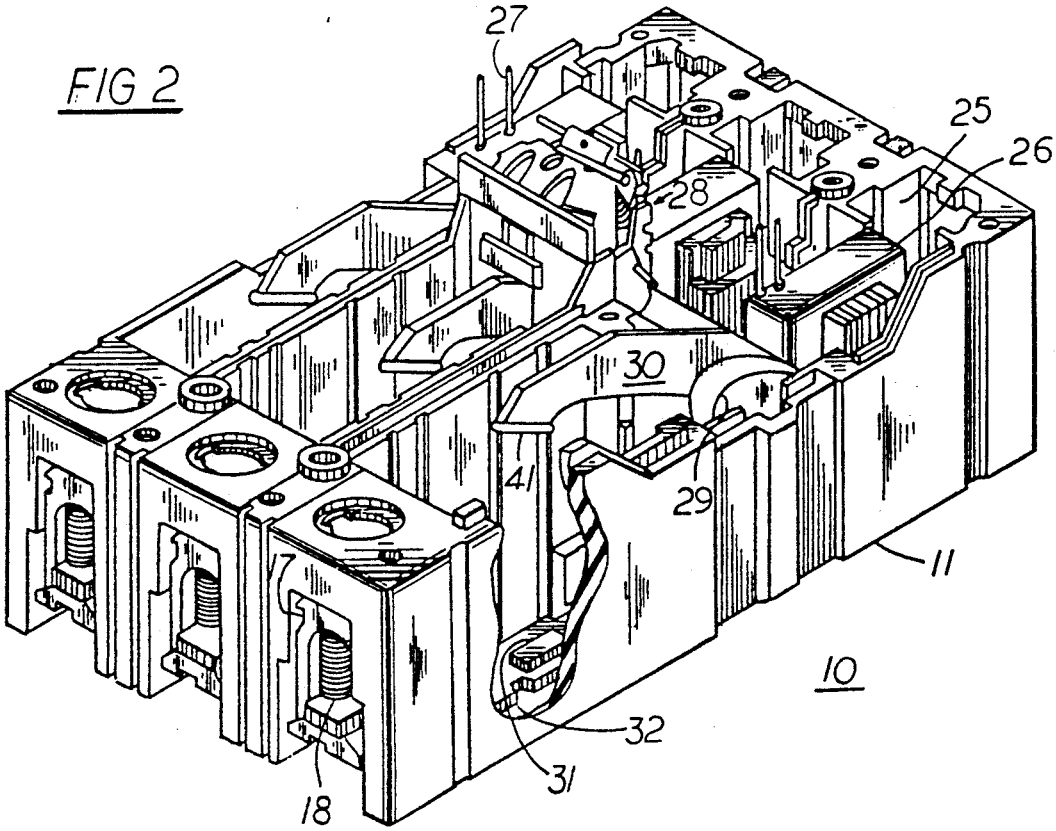
FIG. 2 is a top perspective view of the circuit breaker depicted in FIG. 1 with the cover removed.

Referring now to FIG. 2, the case 11 of the circuit breaker 10 is exposed to show the current path provided from the load lug compartment 25 which contains the load terminal connectors (not shown) that connect with an industrial load and with the current sensing transformers 26 for sensing the magnitude of the circuit current. The current transformers electrically connect with the circuit breaker electronic trip unit contained within the circuit breaker cover by means of the pin connectors 27. The circuit current transfers through the current transformers to the movable contact arms 30 which are rotatably mounted on the circuit breaker crossbar assembly 29. The movable contacts 41 attached to the movable contact arms separably connect with the fixed contacts 31 that are attached to the line terminal straps 32. The line terminal straps directly connect with the line terminal lugs 17 and line terminal screws 18. The ON-OFF condition of the circuit breaker contacts is controlled by the operating mechanism 28 which is in turn controlled by the electronic trip unit. When a predetermined current exists for a predetermined period of time, the operating mechanism drives the crossbar and movable contact arms to the open position indicated in FIG. 2 to thereby interrupt the circuit current by rapidly separating the movable and fixed contacts. When such contacts are separated under overcurrent conditions, an arc is generated therebetween which consists of highly ionized mobile arc gases.

The line terminal lugs are isolated from the arc generated within the case by means of a barrier wall (not shown) such that the arc gases exit by means of the egress slots 21 shown earlier in FIG. 1 formed within the line end 20 of the circuit breaker cover 12 as shown in FIG. 3. Keyway slots 35 formed through the circuit breaker cover communicate with the line terminal access slots 23 to provide access to the line terminal screws. The line terminal inserts 22 are inserted in the keyway slots within the line terminal access slots to prevent electric circuit between the exhaust gases and the line terminal screws upon overcurrent conditions. The line terminal inserts each consist of a planar cylindrical top 36 which is joined to a depending hollow cylinder 37. Peripheral shoulders 42 on the hollow cylinder allows the line terminal insert to be rotated within the keyway slot to attach the insert to the circuit breaker cover 12. An outer perimetric recess 34 formed around the keyway slot receives the top 36 of the line terminal insert and allows the top of the line terminal insert to be flush with the top surface 33 of the circuit breaker cover when the line terminal insert is inserted within the keyway slot. The pair of depressions 36A formed within the top 36 allow for the reception of a bifurcated tool within the depressions to rotate the line terminal inserts upon insertion and removal from the circuit breaker cover.

The positioning of the line terminal inserts 22 within the line terminal access slots 23 formed within the cover 12 of the circuit breaker 10 is best seen by referring to FIG. 4 wherein the line end 20 of the case 11 and cover 12 is arranged facing outwards from the page. The tops 36 of the line terminal inserts are flush with the top surface 33 of the circuit breaker cover when the collar 42 sits within the perimetric recess 34. The depending hollow cylinder 37 thereby prevents the arc gases from contacting the associated line lug 17 and line terminal screw 18.

To prevent the line terminal inserts 22 from becoming separated from each other upon removal from the circuit breaker cover, an apertured plastic plate 44 as shown in FIG. 5 is used in the following manner. A hexagonal recess 43 is formed within the top 36 of the line terminal insert to facilitate use of a hex wrench tool when the line terminal inserts are inserted within the openings 47 formed within the plastic plate. The shoulders 42 on the cylinder 37 are aligned within the keyway slots 48 such that when the terminal insert is rotated, the shoulders become positioned under the plastic plate. Sufficient clearance is provided between the top 36 and the shoulders 42 to allow the plastic plate 44 to be positioned over the line end 20 of the circuit breaker case 12 depicted earlier in FIG. 3 and to allow the shoulders 42 on each of the three terminal line inserts 22 to rotate within the keyway slots 35 formed within the circuit breaker cover. This allows the individual line terminal inserts to be removed from the plastic plate and the circuit breaker cover, if so desired.

A further embodiment of the line terminal insert 22 is depicted in FIG. 6 wherein each of the line terminal inserts are joined by means of flexible plastic tabs 46 integrally-formed with the line terminal inserts. The oversized collars 45 formed on the cylinders 37 extend below the keyway 35 (FIG. 3) and snappingly engage the bottom surface thereof. The tabs 46 are offset at their ends as indicated at 46A such that when the tops 36 are flush with the top surface of the circuit breaker cover the intervening tabs 46 sit on the top surface of the circuit breaker cover.

The line terminal inserts are formed from a thermoplastic plastic that is selected to readily outgas upon contact with the hot exhaust arc gases to cool and deionize the gases as they exit from the line terminal compartments. One such thermoplastic plastic having exceptional arc gas quenching and cooling properties is nylon.

Having thus described our invention, what we claim as new and desire to secure by Letters Patent is:

1. A molded case circuit breaker comprising:

a molded plastic case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings providing egress of arc gases generated when said contacts are separated during said overcurrent condition; and line terminal inserts removably arranged within said access openings providing access to said line terminal connectors while allowing egress of said arc gases, said inserts comprising a hollow planar cylindrical top and a hollow depending cylindrical body member arranged for receiving a tool to permit access to said line terminal while said inserts are within said line terminal compartments.

2. The circuit breaker of claim 1 including a pair of recesses formed within said top on opposite sides thereof, said recesses receiving a tool for inserting and removing said inserts from said access openings.

3. A molded case circuit breaker comprising:

a molded plastic case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings providing egress of arc gases generated when said contacts are separated during said overcurrent condition;

line terminal inserts removably arranged within said access openings providing access to said line terminal connectors while allowing egress of said arc gases, said inserts comprising a hollow planar cylindrical top and a hollow depending cylindrical body member; and an insulative plate having a plurality of support openings formed therein, said line terminal inserts being removably arranged within said support openings.

4. A molded case circuit breaker comprising:

a molded plastic case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings providing egress of arc gases generated when said contacts are separated during said overcurrent condition; and line terminal inserts removably arranged within said access openings providing access to said line terminal connectors while allowing egress of said arc gases, said inserts comprising a planar cylindrical top and a hollow depending cylindrical body member said line terminal inserts being joined by means of a flexible tab.

5. The circuit breaker of claim 4 wherein said flexible tab is integrally-formed with said line terminal inserts.

6. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line terminal inserts removably arranged within said access openings thereby providing access of a tool to said line terminal connectors while allowing egress of said arc gases, said inserts comprising a hollow cylindrical top and a hollow cylinder depending from and formed integral with said top to permit access to said line terminal while said inserts are within said line terminal compartments.

7. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line terminal inserts removably arranged within said access openings providing access of a tool to said line terminal connectors while allowing egress of said arc gases, said inserts comprising a hollow cylindrical top having a keyway-shaped member formed integral with said top arranged for receiving a tool to permit access to said line terminal while said inserts are within said line terminal compartments.

8. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and thermoplastic line terminal inserts removably arranged within said access openings allowing access of a tool to said line terminal connectors while allowing egress of said arc gases, said inserts comprising a hollow cylindrical top and a hollow cylinder body depending from and formed integral with said top arranged for receiving a tool to permit access to said line terminal while said inserts are within said line terminal compartments.

9. The molded case circuit breaker of claim 8 wherein said case and cover comprise a thermoset plastic.

10. The molded case circuit breaker of claim 8 wherein said thermoplastic comprises nylon.

* * * * *